United States Patent [19]

Bishop et al.

[11] Patent Number: 4,648,447

[45] Date of Patent: Mar. 10, 1987

[54] CASING SCRAPER

[75] Inventors: Thomas R. Bishop; Archie W. Peil; Arnal B. Foreman, Jr., all of Houston, Tex.

[73] Assignee: Bowen Tools, Inc., Houston, Tex.

[21] Appl. No.: 774,890

[22] Filed: Sep. 11, 1985

[51] Int. Cl.[4] ..... E21B 37/02

[52] U.S. Cl. ..... 166/173

[58] Field of Search ..... 166/173, 241, 242; 15/109.16; 175/325

[56] References Cited

U.S. PATENT DOCUMENTS 2,811,210 10/1957 Guillot ..... 166/173

3,011,556 12/1961 Best ..... 166/173

3,031,016 4/1962 Conrad ..... 166/173

3,326,294 6/1967 Neilson ..... 166/173

*Primary Examiner*—James A. Leppink

*Assistant Examiner*—William P. Neuder

*Attorney, Agent, or Firm*—Pravel, Gambrell, Hewitt & Kimball

[57] ABSTRACT

A casing scraper which provides substantially 360° of contact between the interior diameter of casing. The cutter blades of the casing scraper are of a segmented tubular shape to provide a substantially 360° contact area. The segmented cutter blades are biased radially outwardly by springs oriented in an alignment housing between the supporting mandrel and the cutter blades.

13 Claims, 5 Drawing Figures

Fig. 3
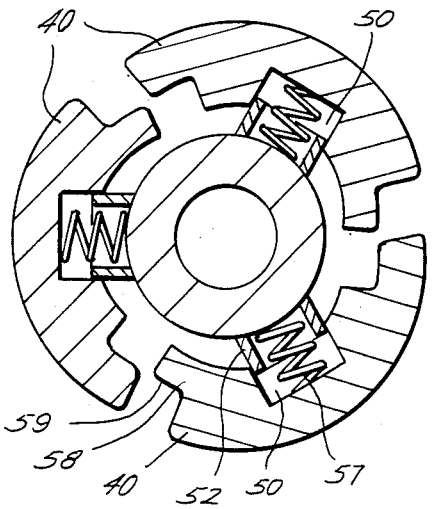
Fig. 4
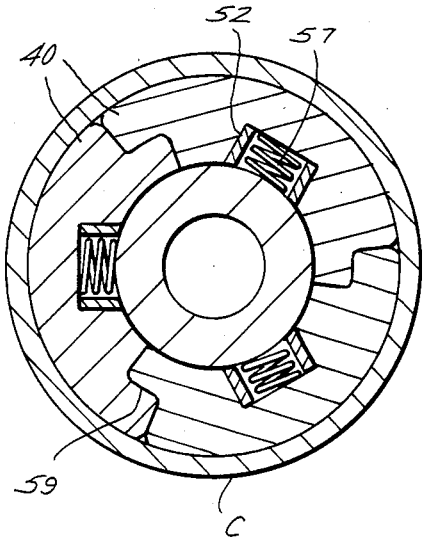
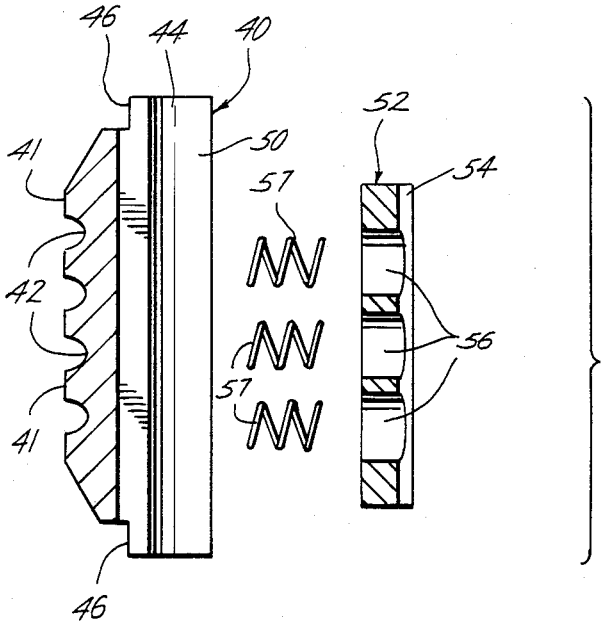
Fig. 5

CASING SCRAPER

FIELD OF THE INVENTION

The present invention relates to a scraper tool for cleaning the interior of tubular members and more particularly a scraper tool having cutter blade assemblies which provide substantially annular contact with the interior surface of tubular members.

BACKGROUND OF THE INVENTION

The cleaning of the interior surface of tubular members is desirable and often necessary in the oil and gas industry where tubular members such as casing are positioned in a well bore. Typically, such cleaning is accomplished by lowering a tool into the casing or well bore and moving the tool so as to cut foreign matter such as cement sheaths, mill scale, burrs, bullets stuck in the casing, etc. from the interior of the casing.

The scraping of a well casing allows close fitting tools such as packers to be lowered into the well casing and activated so as to attach to the casing without becoming stuck in the casing and without being damaged by foreign objects on the interior wall of the casing.

Typical casing scraper tools have required manipulation by rotation or reciprocation in the well bore in order to provide the scraping action to all areas of the interior diameter of the casing. In U.S. Pat. No. 3,032,114, cutter blades on a scraper tool were spaced apart circumferentially about the tool, resulting in potentially incomplete or inadequate scraping of the tubular member due to the open areas between the adjacent cutter blades.

SUMMARY OF THE INVENTION

The present invention relates to a new and improved scraper tool to clean the interior surface of tubular members and in particular to clean the interior surface of well casing.

The present invention provides a casing scraper tool having a substantially 360° contact area to provide for a substantially complete scraping of the casing without the requirement of rotating the scraper or the possibility of missing an area of the casing due to spaces between adjacent scraper blades.

The present invention further provides a spring alignment housing to provide alignment and support for the springs employed to bias the scraper cutter blades radially outwardly from a supporting mandrel.

BRIEF DESCRIPTION OF THE DRAWINGS

FIG. 3 is an cross-sectional view along line 3—3 of FIG. 2 showing the cutter blades expanded.

FIG. 4 is a cross-sectional view along line 3—3 of FIG. 2 showing the cutter blades retracted in a pipe.

FIG. 5 is an exploded view of one of the scraper or cutter blades, the springs, and the housing therefor.

DESCRIPTION OF THE PREFERRED EMBODIMENT

Figure 1:
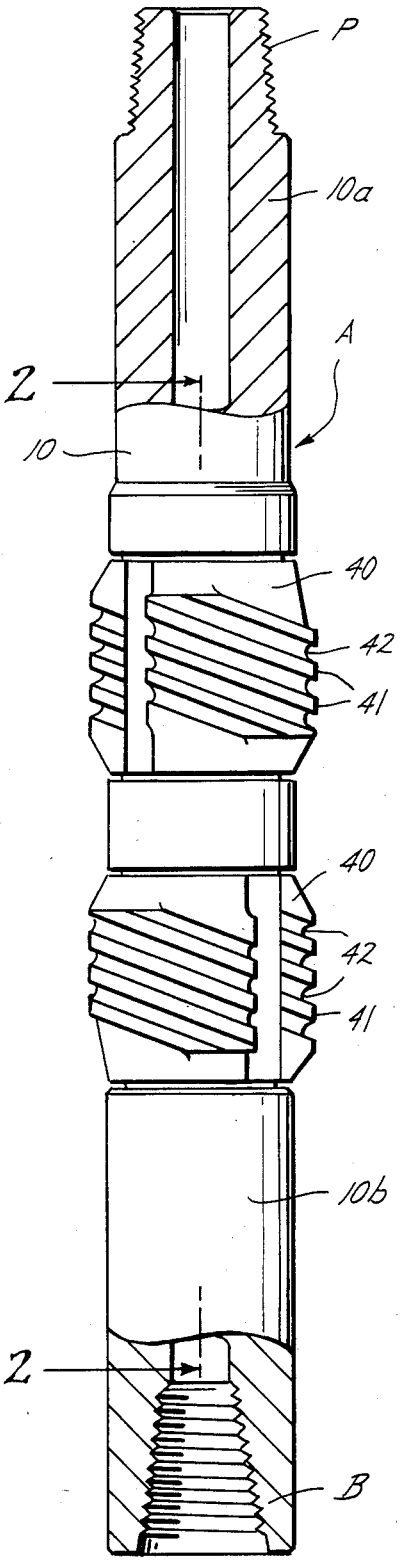
FIG. 1 is an elevational view, partially in section, of the scraper tool of the present invention.

The apparatus A of the present invention is adapted for running in a well casing on a conventional tubing string (not shown). As shown in FIG. 1, a mandrel 10 includes an upper section 10*a* having a threaded pin section P to threadedly connect with a tubing string thereabove (not shown). The mandrel lower section 10*b* includes a threaded box section B to threadedly receive a lower pipe string (not shown). In use, the apparatus A is normally located in a string of pipe to enable it to be lowered into a well casing for performing scraping or cleaning operations inside a casing. The mandrel upper section 10*a* and lower section 10*b* are joined by a threaded connection 12 more fully described hereinbelow.

The mandrel upper section 10*a* includes a reduced diameter longitudinal section 14 which forms a longitudinally and circumferentially extending upper recess 16 on mandrel 10. The upper recess 16 has an undercut portion 18 formed by an annular downwardly extending retaining lip 19. An annular projection or ring 20 forms the lower joint of the recess 16 and separates the upper recess 16 from a lower recess 30. Lip 19 is engaged by fingers 46 of the cutter blades as described below.

Lower recess 30 extends from annular projection 20 to a threaded extension 22 of mandrel upper section 10*a*. Threaded extension 22 is adaptd to receive lower section 10*b* of mandrel 10. An upwardly extending retaining lip 32 is formed on lower section 10*b* to thereby form undercut portion 24 when threaded with upper section 10*a*. Lip 32 is engaged by depending fingers 46 of the cutter blades described below. Surrounding annular section 20 is annular ring 23 which is releasably positioned around annular protection 20, as will be explained. Orientation of annular ring 23 about annular projection 20 forms retaining extensions 25 which engage with adjacent fingers 46 of the cutter blades described below.

A plurality of arcuate cutter blades 40 are provided, each of which includes cutter teeth 41 formed by a plurality of spaced grooves 42 which preferably extend at an oblique angle relative to the longitudinal axis of the cutter blade. The cutter teeth 41 are usually tool steel or other suitable material to resist wear. Each end 44 of each cutter blade 40 includes extending fingers 46 to engage with extending lips 19 and 32 and retaining extensions 25, as more fully explained below.

The inside of each cutter blade 40 includes a recess 50 adapted to receive a spring housing block 52 (FIG. 5). Spring housing block 52 includes an arcuate surface 54 which generally conforms in shape to the external surface of the recessed portions of mandrel 10. Extending through spring block 52 from arcuate surface 54 are three holes or bores 56 adapted to receive coil biasing springs 57. Coil springs 57 contact mandrel 10 and cutter blade 40 to bias cutter blade 40 radially outwardly. Spring block 52 maintains the relative position of each biasing spring 57.

Each cutter blade 40 is an arcuate segment of a circle, such that when a set of cutter blades are oriented upon mandrel 10 a substantially circular cutter assembly C is provided. Each cutter blade includes on each of its longitudinal ends 58 an S-shaped contact surface 59 to overlap and interfit with a corresponding S-shaped contact surface 59 on the adjacent blades (See FIGS. 3 and 4). The interfitting contact surfaces 59 provide for a substantially continuous engagement of each of the sets 60 and 62 of cutter blades in various pipe diameters.

Figure 2:
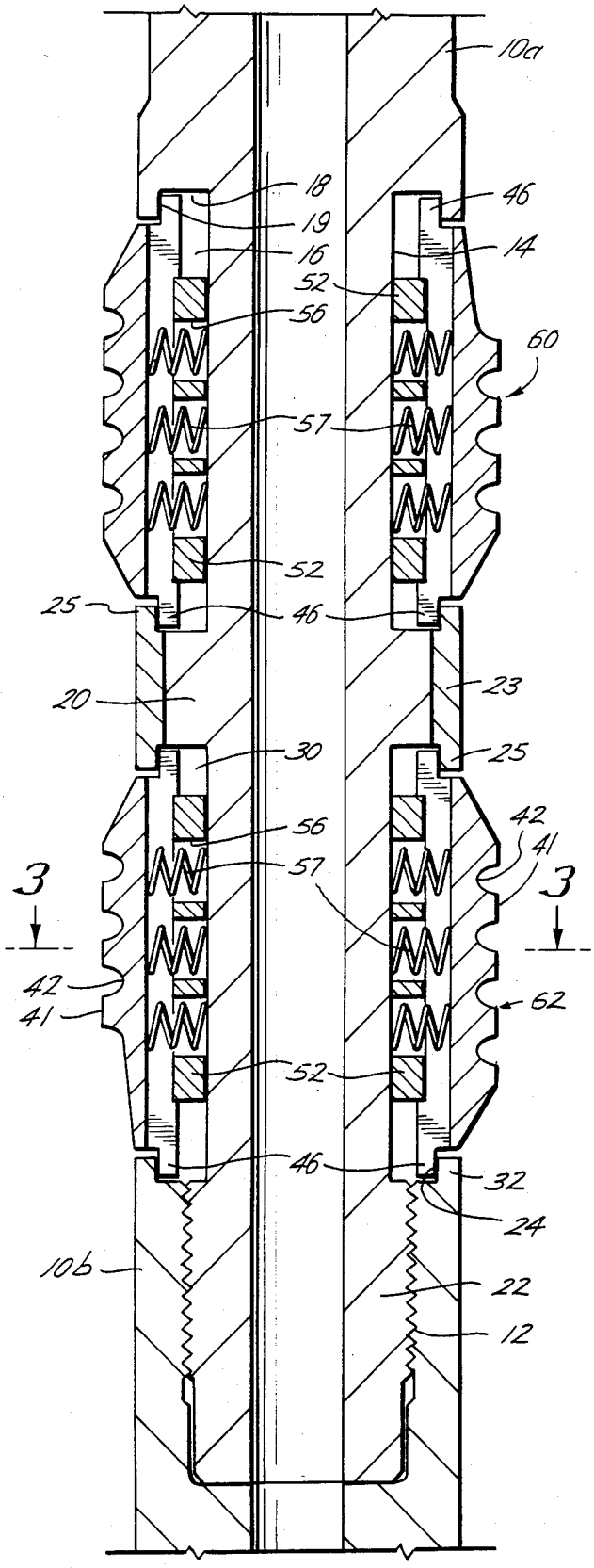
FIG. 2 is an enlarged sectional view along line 2—2 of FIG. 1.

The scraper tool is assembled with the mandrel portion 10*b* removed from the mandrel portion 10*a*. The first or upper set 60 of three cutter blades 40 are placed on mandrel 10 with their upper fingers 46 positioned beneath undercut 18. When so positioned, each cutter blade 40 has a spring housing 52 and springs 57 located within recess 50, and with the springs 57 compressed enough to maintain sufficient radial outward force on each blade 40 to maintain blades 40 urged into contact with the inside of a casing C even when in the fully extended position (FIGS. 2 and 3) with sufficient force to effect a scraping or cutting action on the inside of the casing.

Annular ring 23 is then longitudinally slid onto the mandrel until it is disposed adjacent annular projection 20 with its extensions 25 extending over lower fingers 46 of the cutter blades of set 60, thereby confining upper cutter assembly 60 on mandrel 10 while allowing limited radial movement of the cutter blades 40 biased radially outwardly by springs 57 from the fully retracted position (FIG. 4) to the fully extended position (FIG. 3) depending on the inside diameter of the casing relative to the blades 40.

Next, the cutter blades 40 of lower cutter assembly 62 are positioned around mandrel 10 with the spring housings 52 and springs 57, and with the upper fingers 46 of cutter blades 40 in set 62 extending under extensions 25 of annular ring 20. Lower mandrel section **10*b* is then threaded to upper mandrel section 10*a* to position retainer lip 32 around the lower fingers 46 of the cutter blades 40 of the set 62, thereby confining both lower cutter assembly 62 and upper cutter assembly 60 on mandrel 10**.

In use, the scraper tool is lowered within a casing or pipe string to be cleaned. The tool is rotated and/or reciprocated to effect the cleaning of the inside surface of the casing. Each of the radially outwardly biased cutter assemblies 60 and 62 provides substantially 360° of contact between the cutter blades 40 and the interior surface of the casing. Further, the upper set 60 is preferably oriented circumferentially with respect to the lower set 62 (for example, 30 degrees) so that the relatively small spacing between the blades 40 in the upper set 60 is offset circumferentially from the corresponding spacing between the blades 40 in the lower set 62, whereby the blades 40 of the upper set 50 will contact the casing being scraped at the areas of the spacing between the blades 40 of the lower set 62. Similarly, the blades 40 of the lower set 62 will contact the casing of the areas of the spacing of the blades 40 on the upper set 60.

In practice, the outer diameter of the cutter blade assemblies 60 and 62 is determined by the interior diameter of the casing to be cleaned. Before insertion of the apparatus A into the casing small spaces exist between adjacent cutter blades 40 which are biased outwardly by springs 57 (FIG. 3). Upon insertion of the apparatus A into the casing, contact between the cutter blades 40 and the casing compresses springs 57 through contact of the cutter blades 50 with the interior of the casing. The intermeshing of adjacent cutter blades 50 as they are forced radially inwardly by contact with the casing essentially eliminates or minimizes the space between adjacent cutter blades 40 (FIG. 4).

Although the invention is described as including two adjacent cutter blade assemblies 60 and 62, the invention is readily adaptable to a single cutter blade assembly. In adapting to a single cutter blade assembly, the threaded extension 22 and the upwardly extending retainer lip 32 formed on lower section **10*b* which forms undercut portion 24 to be engaged by depending fingers 46 of the butter blades would be oriented in place of annular projection 20 and annular ring 23. Such an adaptation to a single cutter blade assembly would provide substantially annular contact with the interior surface of the casing due to the minimization of the space between adjacent cutter blades 40. Further, although the invention is described as including three cutter blades per cutter assembly, the invention is readily adaptable to cutter assemblies comprising two or more cutter blades without departing from the spirit and scope of the invention. Also, although coil springs 57** are preferred, other resilient biasing means may be employed in place of coil springs.

It should be understood that the foregoing description and the drawings of the invention are not intended to be limiting, but are only exemplary of the inventive features which are defined in the claims.

What is claimed is:

1. A scraper for tubular members which provides substantially 360° of contact with the interior of the tubular member which comprises:

a mandrel adapted to be lowered in a tubular member in a well;

said mandrel having a circumferential recess;

a plurality of scraper blades positioned in said recess;

resilient means in said recess oriented in an alignment housing adapted to fit within said recess between said mandrel and said blades, said resilient means to urge said blades radially outwardly;

means on said mandrel for confining said blades on said mandrel and for limiting the extent of outward urging of said blades; and each of said blades having a longitudinally extending step portion along each longitudinal edge which interfits in circumferentially overlapping contact with a corresponding longitudinally extending step portion on the adjacent blade to provide a minimum of circumferential space between adjacent blades from the blades fully retracted position to the blades fully extended position, and to provide for radial interaction between adjacent blades during radial movement of said blades, through said circumferentially overlapping contact between adjacent blades, whereby maximum scraping contact with the casing is obtained.

2. The scraper of claim 1, wherein said circumferential recess is defined by an upper undercut annular portion on a first mandrel section and by a lower undercut annular portion formed by a second mandrel section adapted to receive said first mandrel section.

3. The scraper of claim 1, wherein said resilient means comprises a plurality of coil springs adapted to fit within openings in said alignment housing.

4. The scraper of claim 2, wherein said means for limiting outward urging of said blades comprises fingers extending from said blades adapted to engage said upper and said lower undercut annular portions.

5. A scraper for tubular members which provides substantially 360° of contact with the interior of the tubular member which comprises:

a first mandrel section having a reduced diameter segment forming a longitudinally extending circumferential recess defined by an upper undercut annular portion;

a second mandrel section adapted to receive said first mandrel section forming a lower undercut annular portion;

a plurality of scraper blades which include longitudinally extending step portions along each longitudinal edge which interfit in circumferentially overlapping contact with corresponding longitudinally extending step portions on the adjacent blade to provide for radial interaction between adjacent blades during radial movement of said blades, positioned in said recess forming a substantially continuous circumferential ring around said mandrel and retained therein by scraper blade fingers engaging said upper and said lower undercut portions; and each of the said scraper blades including a recess on an inner surface thereof to receive a housing orienting biasing means between said scraper blades and said mandrel to bias said scraper blades radially outwardly.

6. The scraper of claim 5, wherein said biasing means comprises a plurality of coil springs adapted to fit within openings in said housings.

7. A scraper for well pipe which provides substantially 360° of contact with the interior of a tubular member which comprises:

a first upper section of a mandrel having a reduced diameter segment forming a longitudinally extending continuous circumferentially extending recess defined by an upper undercut annular portion and a lower annular collar from which extends a second reduced diameter lower portion; and a second lower mandrel section adapted to receive a portion of said lower reduced diameter portion thereby defining a lower reduced diameter longitudinally extending continuous circumferentially extending recess having an lower undercut annular portion;

a plurality of scraper blades which include longitudinally extending step portions along longitudinal edges which interfit in circumferentially overlapping contact with corresponding longitudinally extending step portions on the adjacent blade, positioned in said upper and lower reduced diameter sections, said scraper blades forming substantially continuous interfitted circumferential rings around said mandrel in which radial contact at the longitudinal step portion between adjacent blades is maintained during radial movement of said blades;

each of said scraper blades including a recess on an inner surface thereof to receive a housing, orienting biasing means between said scraper blades and said mandrel to bias said scraper blades radially outwardly; and an annular hold down ring removably fitted about said annular collar between said upper and said lower recesses extending over portions of said scraper blades to retain said scraper blades on position on said mandrel.

8. The scraper of claim 7, wherein said biasing means comprises a plurality of coil springs adapted to fit within openings in said housings.

9. A casing scraper for scraping the interior of tubular members wherein the improvement comprises providing a plurality of cutter blades which interlock so as to form a substantially tubular cutting assembly concentric with a supporting mandrel in which an interlocking contact of corresponding longitudinally extending step portions on adjacent blades provides for radial contact between adjacent blades during radial expansion and contraction of said cutter assembly, each of said cutter blades including a recess to receive a housing for biasing means between said cutter blades and said mandrel.

10. The casing scraper of claim 9, wherein said biasing means comprises coiled springs.

11. A scraper for well pipe which provides substantially 360° contact with the interior of a tubular member which comprises a mandrel adapted to be run in a well pipe having a first upper reduced diameter segment forming a longitudinally extending continuous circumferentially extending recess defined by an upper undercut annular portion and a lower annular collar from which extends a second reduced diameter segment forming a lower longitudinally extending continuous circumferentially extending recess having a lower undercut annular portion;

a plurality of scraper blades positioned in said upper and said lower reduced diameter segments, said scraper blades forming substantially continuous circumferential rings around said mandrel wherein adjacent blades include longitudinally extending step portions which interfit in overlapping contact with corresponding longitudinally extending step portions on adjacent blades to provide for interacting radial contact between adjacent blades during radial expansion and contraction of said cutter assembly, each of said scraper blades including a recess on an inner surface thereof to receive a housing, orienting the biasing means between the scraper blades and said mandrel to bias said scraper blades radially outwardly; and an annular hold down ring removably fitted about said annular collar between said upper and said lower recess segment extending over portions of said scraper blades to retain said scraper blades in position on said mandrel.

12. The scraper of claim 11, wherein said lower undercut annular portion is formed by orientation of said second lower reduced diameter segment in a lower mandrel section.

13. The scraper of claim 11, wherein said biasing means comprises a plurality of coil springs adapted to fit within openings in said housing.

* * * * *